US009673549B2

(12) United States Patent
Nakano et al.

(10) Patent No.: US 9,673,549 B2
(45) Date of Patent: Jun. 6, 2017

(54) CONNECTOR WITH MOVEMENT SUPPRESSION FUNCTION DURING EXCESSIVE VIBRATION

(71) Applicant: TOYOTA JIDOSHA KABUSHIKI KAISHA, Toyota-shi, Aichi-ken (JP)

(72) Inventors: Ato Nakano, Toyota (JP); Yasuhiro Tanaka, Kakegawa (JP)

(73) Assignee: TOYOTA JIDOSHA KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/965,354

(22) Filed: Dec. 10, 2015

(65) Prior Publication Data

US 2016/0181706 A1 Jun. 23, 2016

(30) Foreign Application Priority Data

Dec. 17, 2014 (JP) ..... 2014-255467
Oct. 23, 2015 (JP) ..... 2015-209289

(51) Int. Cl.
*H01R 13/187* (2006.01)
*H01R 13/11* (2006.01)

(52) U.S. Cl.
CPC ..... *H01R 13/187* (2013.01); *H01R 13/111* (2013.01)

(58) Field of Classification Search
CPC ..... H01R 13/187
USPC ..... 439/877
See application file for complete search history.

(56) References Cited

U.S. PATENT DOCUMENTS 5,088,942 A * 2/1992 Welsh ..... H01R 43/16 439/843
6,358,104 B2 * 3/2002 Daugherty ..... H01R 13/187 439/851
8,038,488 B2 * 10/2011 Mukuno ..... H01R 4/4881 439/845
8,128,441 B2 * 3/2012 Mukuno ..... H01R 13/055 439/845
8,668,531 B2 * 3/2014 Yamaguchi ..... H01R 13/187 439/843
8,827,754 B2 * 9/2014 Lee ..... H01R 13/113 439/843

(Continued)

FOREIGN PATENT DOCUMENTS

JP 2013-187170 A 9/2013

*Primary Examiner* — Tulsidas C Patel
*Assistant Examiner* — Peter G Leigh
(74) *Attorney, Agent, or Firm* — Oliff PLC

(57) ABSTRACT

A connector including: a male terminal; a female terminal having a tube into which the male terminal is inserted; and an elastic member assembled inside the tube, wherein protrusions inwardly protruding are formed on an inner wall of the tube, the protrusions include: first protrusions provided at positions where two straight lines extending from one point on an axis of the tube cross the inner wall, the two straight lines forming a first angle therebetween and each being perpendicular to the axis; and second protrusions provided at positions where two straight lines extending from one point on the axis cross the inner wall, the two straight lines forming a second angle and each being perpendicular to the axis, the first protrusions and two second protrusions being provided in a direction parallel to the axis, and the elastic member urges the male terminal inserted in the tube, toward the protrusions side.

3 Claims, 11 Drawing Sheets

(56) References Cited

U.S. PATENT DOCUMENTS

2001/0051472 A1* 12/2001 Sato ..... H01R 13/11
439/852

* cited by examiner

CONNECTOR WITH MOVEMENT SUPPRESSION FUNCTION DURING EXCESSIVE VIBRATION

FIELD OF THE INVENTION

The present invention relates to a connector to be used for providing electrical connection.

DESCRIPTION OF THE BACKGROUND ART

As an example of a connector to be used for providing electrical connection, a connector to be mounted on a vehicle is described in Patent Literature 1 (Japanese Laid-Open Patent Publication No. 2013-187170). As shown in FIG. 12, a connector 100 described in Patent Literature 1 is composed of a female terminal 110 having a substantially cylindrical shape, a male terminal 120 having a substantially cylindrical shape, and an elastic member 130 having a substantially cylindrical shape. The elastic member 130 is composed of a spring part 133 having a plurality of springs, which connect annular frame parts, are capable of applying elastic force, and are arranged in parallel, with gaps therebetween.

The elastic member 130 is assembled inside the female terminal 110 and in electrical contact with the female terminal 110. When the male terminal 120 is inserted in the female terminal 110, the spring part 133 having the plurality of springs of the elastic member 130 come into contact with the outer circumferential surface of the male terminal 120. Via the plurality of these contact points, the female terminal 110 and the male terminal 120 are electrically connected to each other. Friction force applied to the male terminal 120 caused by the contact load (spring load) of the elastic member 130 suppresses relative movement of the male terminal relative to the female terminal caused by vibration of the connector 100.

With the structure of the connector described in Patent Literature 1 above, suppression of the relative movement of the male terminal relative to the female terminal caused by vibration applied to the connector is dependent on the pressing force caused by the contact load of the spring part. Thus, if the magnitude of the vibration applied to the connector exceeds the pressing force, there is a risk that relative movement of the male terminal relative to the female terminal in the connector cannot be suppressed. The relative movement of the male terminal relative to the female terminal could cause contact sliding between terminals and further could cause increase in the resistance value due to abrasive wear of the contacts.

SUMMARY OF THE INVENTION

In view of the above problem, an object of the present invention is to provide a connector having a structure that can suppress relative movement of the male terminal relative to the female terminal caused by vibration applied to the connector.

In order to solve the above problem, a connector according to a first aspect of the present invention includes: a male terminal; a female terminal having a tubular part into which the male terminal is inserted; and an elastic member assembled inside the tubular part of the female terminal. In the connector, a plurality of protrusions inwardly protruding are formed on an inner wall of the tubular part of the female terminal, the plurality of protrusions at least include: two first protrusions provided at positions where two first straight lines extending from one point on an axis of the tubular part cross the inner wall of the tubular part, the two first straight lines forming a first angle therebetween and each being perpendicular to the axis of the tubular part; and two second protrusions provided at positions where two second straight lines extending from one point on the axis of the tubular part cross the inner wall of the tubular part, the two second straight lines forming a second angle and each being perpendicular to the axis of the tubular part, the two first protrusions and the two second protrusions being provided in a direction parallel to the axis of the tubular part, and the elastic member urges the male terminal inserted in the tubular part of the female terminal, toward the plurality of protrusions side.

In the connector according to the first aspect of the present invention, inside the tubular part of the female terminal in which the male terminal is inserted and fitted, the elastic member which holds the male terminal inserted in the tubular part is assembled. In addition, the protrusions inwardly protruding are formed on the inner wall of the tubular part of the female terminal. Accordingly, the male terminal inserted in the tubular part of the female terminal can be sandwiched by the protrusions formed on the inner wall of the tubular part of the female terminal and the elastic member capable of applying elastic force. The elastic member urges the male terminal inserted in the tubular part of the female terminal, toward the plurality of protrusions side. These protrusions are not elastic and thus restrict movement of the male terminal. Accordingly, it is possible to suppress relative movement, of the male terminal relative to the female terminal, that occurs due to vibration applied to the connector. For example, even if the magnitude of vibration applied to the connector exceeds the pressing force holding the male terminal, movement of the male terminal is restricted by the protrusions. Thus, it is possible to reduce the risk that contact sliding occurs between the male terminal and the female terminal (spring member) and the resistance value is increased due to abrasive wear of the contacts.

In the connector according to a second aspect based on the first aspect of the present invention, the first angle formed between the two first straight lines is identical to the second angle formed between the two second straight lines.

Further, in the connector according to a third aspect of the present invention, the two first protrusions and the two second protrusions are provided on an identical plane that is parallel to the axis of the tubular part.

In the connector according to each of the second aspect and the third aspect of the present invention, the male terminal is held by the two first protrusions and the two second protrusions as well as the elastic member provided in this manner, vibration in the up-down/left-right direction and vibration in the up-down prying direction can be effectively suppressed.

As described above, according to the connector of the present invention, it is possible to suppress relative movement, of the male terminal relative to the female terminal, that occurs due to vibration applied to the connector.

These and other objects, features, aspects, and advantages of the present invention will be become more apparent from the flowing description of the present invention when taken in conjunction with the accompanying drawings.

DESCRIPTION OF THE PREFERRED EMBODIMENTS

Hereinafter, one embodiment of a connector according to the present invention will be described with reference to the drawings.

[Outline]

In the connector according to the present invention, protrusions inwardly protruding are formed on the inner wall of a cylindrical part of a cylinder-type female terminal in which a round-pin-type male terminal is fitted. In addition, an elastic member partially having a spring part capable of applying elastic force is assembled in the cylindrical part of the female terminal. Here, the elastic member is assembled such that the spring part is located at a position opposite to the protrusions. The protrusions and the spring part of the elastic member press and hold the male terminal fitted in the cylindrical part of female terminal. Accordingly, even if the magnitude of vibration applied to the connector exceeds the pressing force holding the male terminal, movement of the male terminal is restricted by the protrusions. Thus, relative movement of the male terminal relative to the female terminal can be suppressed.

[Structure of Connector]

Figure 1:
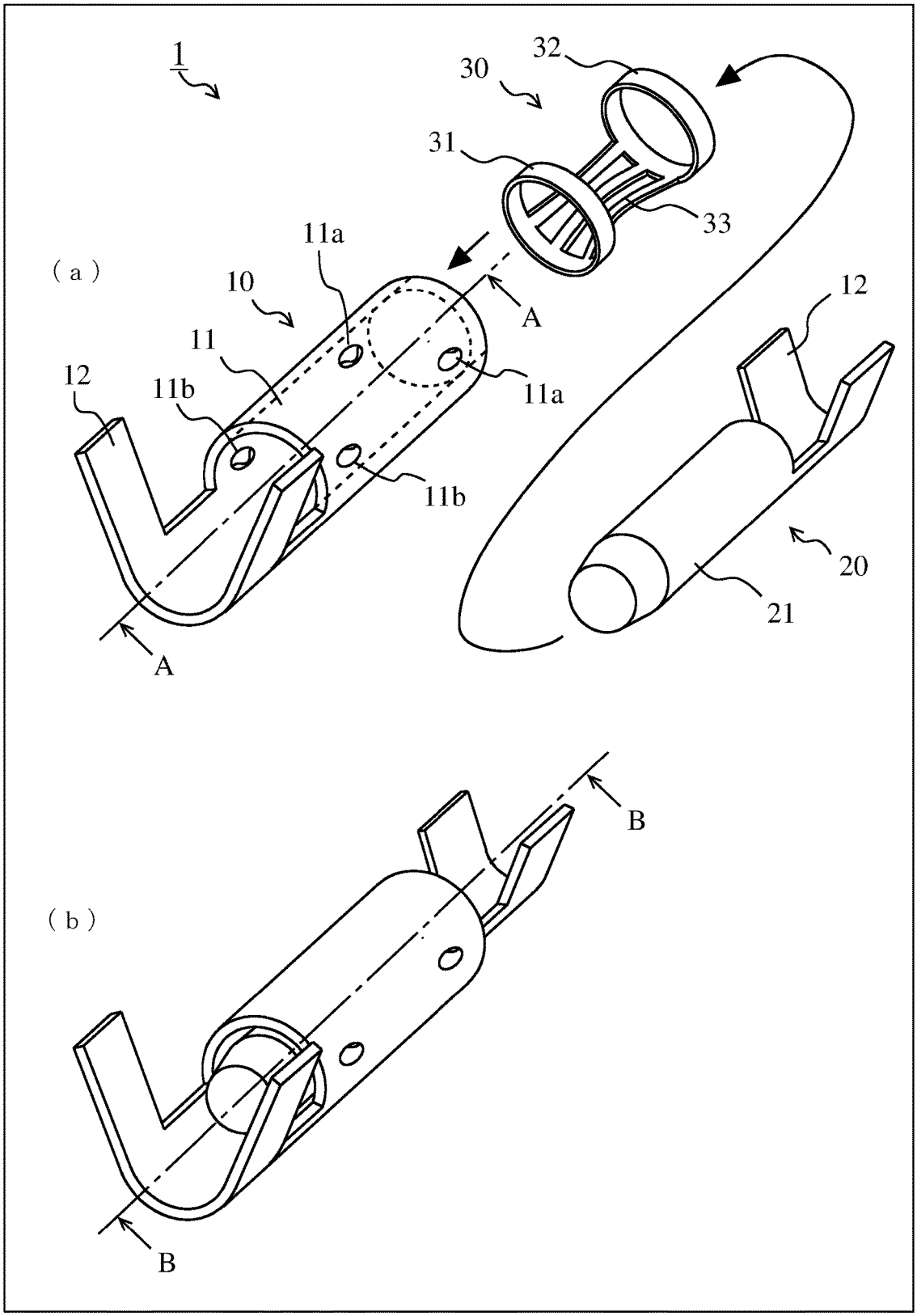
FIG. 1 is a diagram illustrating the structure of a connector according to one embodiment of the present invention.
Figure 2:
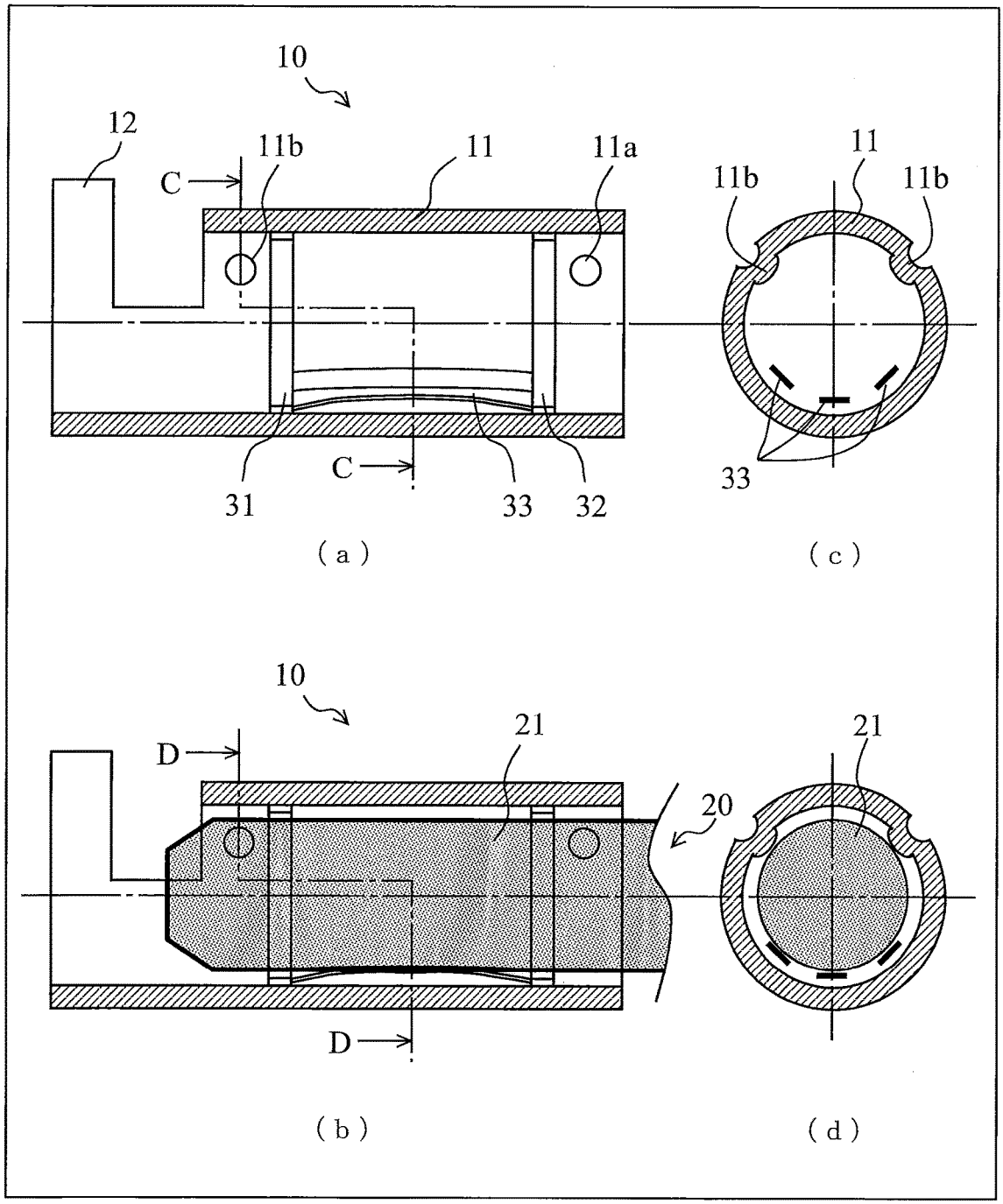
FIG. 2 shows cross-sectional views of a major portion of the connector according to one embodiment of the present invention.

First, with reference to FIG. 1 and FIG. 2, the structure of a connector 1 according to one embodiment of the present invention will be described. (a) of FIG. 1 is a perspective view illustrating the shapes of components forming the connector 1. (b) of FIG. 1 is a perspective view showing a state of the connector 1 in which terminals are fitted together. For easier understating of the shapes of the components, (a) of FIG. 1 shows the inside of the configuration partially in a see-through manner. (a) of FIG. 2 is a cross-sectional view taken along a line A-A in (a) of FIG. 1. (b) of FIG. 2 is a cross-sectional view taken along a line B-B in (b) of FIG. 1. (c) of FIG. 2 is a cross-sectional view taken along a line C-C in (a) of FIG. 2. (d) of FIG. 2 is a cross-sectional view taken along a line D-D in (b) of FIG. 2.

As shown in FIG. 1, the connector 1 according to the present embodiment includes a female terminal 10, a male terminal 20, and an elastic member 30. The elastic member 30 is assembled inside the female terminal 10. The male terminal 20 is inserted into the female terminal 10 having the elastic member 30 assembled therein. In the connector 1 according to the present embodiment, by the male terminal 20 being inserted to be fitted in the female terminal 10 ((b) of FIG. 1), the male terminal 20 and the female terminal 10 are electrically connected to each other via the elastic member 30.

The male terminal 20 is a member formed from an electrically-conductive metal material and in a substantially cylindrical shape, and is a so-called round-pin-type terminal. The male terminal 20 is composed of an insertion part 21 having a cylindrical shape and a conductor barrel part 12 formed so as to be continued from the insertion part 21. The outer diameter of the insertion part 21 is smaller than the inner diameter of the frame parts of the elastic member 30 and than the inner diameter of the cylindrical part of the female terminal 10 described later ((b) of FIG. 2). The leading end of the insertion part 21 is tapered, thereby facilitating insertion of the male terminal 20 into the female terminal 10 (the elastic member 30). The conductor barrel part 22 is the portion where the male terminal 20 is electrically connected, through soldering or crimping by swaging, to an exposed conductor portion of a covered wire not shown.

The elastic member 30 is a member formed from a metal material having electrical conductivity and elasticity. The elastic member 30 is composed of frame parts 31 and 32 each having an annular shape, and a spring part 33. The inner diameter of each of the frame parts 31 and 32 is greater than the outer diameter of the insertion part 21 of the male terminal 20 ((a) of FIG. 2). The spring part 33 connects the frame part 31 and the frame part 32 with the axes of the frame parts substantially aligned with each other. In the example shown in (a) of FIG. 1, the frame part 31 and the frame part 32 are connected to each other by means of the spring part 33 having three springs. The spring part 33 is shaped such that the center portion thereof is curved toward the axis side of the frame parts 31 and 32 ((a) of FIG. 1, (a) of FIG. 2). The elastic member 30 presses and holds the fitted male terminal 20 by means of the curved center portion ((b) and (d) of FIG. 2).

The female terminal 10 is a member formed from an electrically-conductive metal material and in a substantially cylindrical shape. The female terminal 10 is composed of a cylindrical part 11 having a cylindrical shape, and a conductor barrel part 12 formed so as to be continued from the cylindrical part 11. Similarly to the conductor barrel part 12 described above, the conductor barrel part 12 is the portion where the female terminal 10 is electrically connected, through soldering or crimping by swaging, to an exposed conductor portion of the covered wire not shown.

The cylindrical part 11 is the portion into which the insertion part 21 of the male terminal 20 is inserted. Protrusions inwardly protruding are provided on the inner wall of the cylindrical part 11 ((c) of FIG. 2). These protrusions are formed by hammering the cylindrical part 11, for example. The protrusions in the present embodiment are composed of: two front protrusions 11*a* formed on the side, of the cylindrical part 11, on which the male terminal 20 is inserted (hereinafter, referred to as front side); and two rear protrusions 11*b* formed on the side, of the cylindrical part 11, on which the conductor barrel part 12 is formed so as to be continued therefrom (hereinafter, referred to as rear side) ((a) of FIG. 1). The two front protrusions (first protrusions) 11*a* are provided at positions where two straight lines extending from one point on the axis of the cylindrical part 11 cross the inner wall of the tubular part of the cylindrical part 11, the two straight lines forming a predetermined angle (first angle) therebetween and each being perpendicular to the axis of the cylindrical part 11. The two rear protrusions (second protrusions) 11*b* are provided at positions where two straight lines extending from one point on the axis of the cylindrical part 11 cross the inner wall of the tubular part of the cylindrical part 11, the two straight lines forming a predetermined angle (second angle) therebetween and each being perpendicular to the axis of the cylindrical part 11. In the present embodiment, the four front protrusions 11*a* and rear protrusions 11*b* are provided on an identical plane that is parallel to the axis of the cylindrical part 11. In addition, the interval between the two front protrusions 11*a* and the two rear protrusions 11*b* is longer than the dimension (the length from the frame part 31 to the frame part 32) in the longitudinal direction of the elastic member 30.

That is, the elastic member 30 is assembled, inside the cylindrical part 11, at a position sandwiched by the two front protrusions 11*a* and the two rear protrusions 11*b* ((a) of FIG. 2) The elastic member 30 is assembled inside the cylindrical part 11 such that the spring part 33 is located on the opposite side to the front protrusions 11*a* and the rear protrusions 11*b*, relative to the axis of the cylindrical part 11 ((c) of FIG. 2). Therefore, the elastic member 30 urges the male terminal 20 inserted in the cylindrical part 11 of the female terminal 10, toward the front protrusions 11*a* and the rear protrusions 11*b*.

Figure 3:
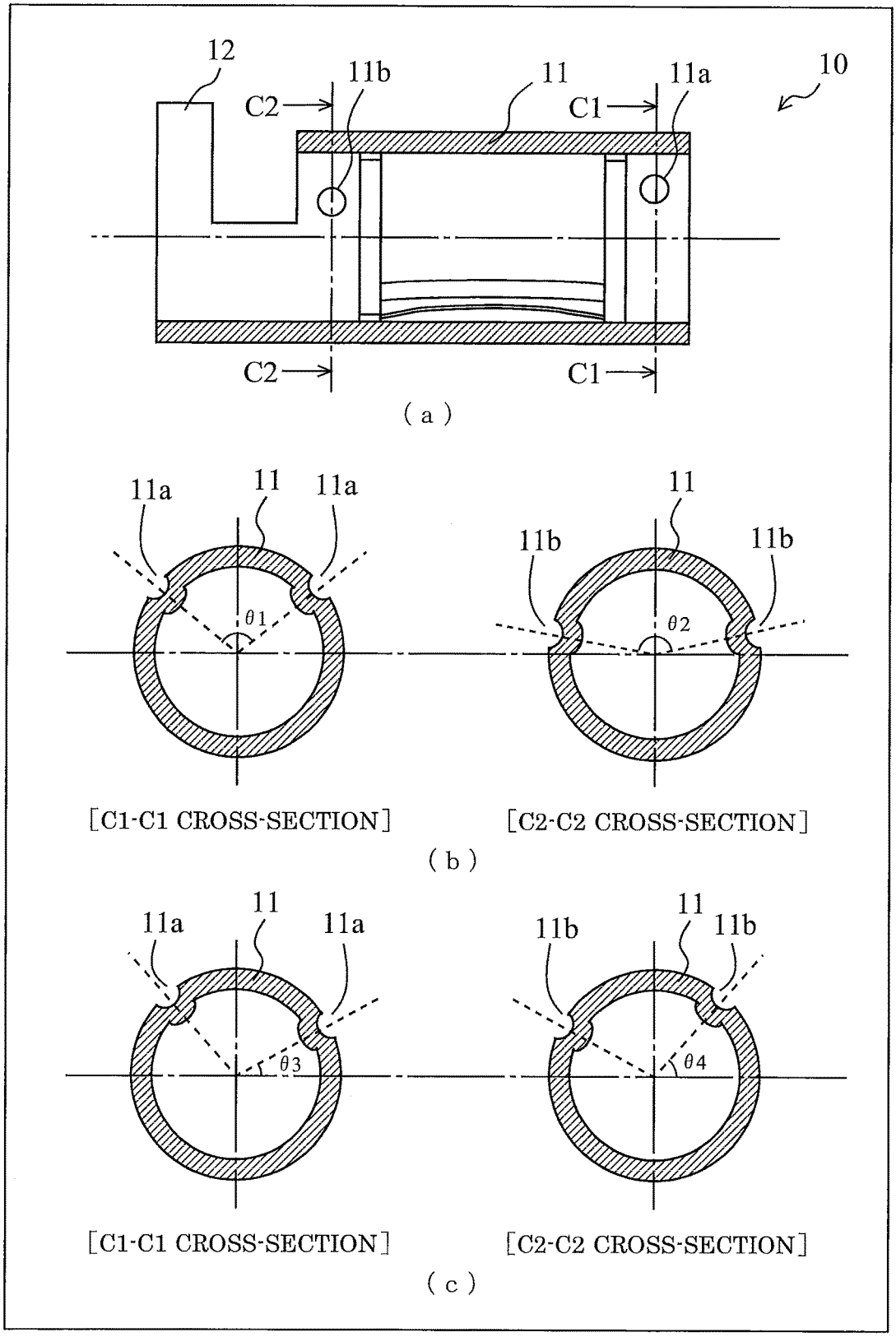
FIG. 3 shows other cross-sectional views of a major portion of the connector according to one embodiment of the present invention.

With reference to FIG. 3, other positions at which the four front protrusions 11*a* and rear protrusions 11*b* can be provided will be explained. (a) of FIG. 3 is a cross-sectional view of another female terminal 10 that can be used in the connector 1. (b) of FIG. 3 is one example of a cross-sectional view taken along a line C1-C1 in (a) of FIG. 3 and a cross-sectional view taken along a line C2-C2 in (a) of FIG. 3. (c) of FIG. 3 is another example of a cross-sectional view taken along the line C1-C1 in (a) of FIG. 3 and a cross-sectional view taken along the line C2-C2 in (a) of FIG. 3.

As shown in (b) of FIG. 3, an angle θ1 between the two front protrusions 11*a* may be different from an angle θ2 between the two rear protrusions 11*b* (θ1≠θ2). Moreover, as shown in (c) of FIG. 3, an angle θ3 by which the set of the two front protrusions 11*a* is inclined relative to the axis of the cylindrical part 11 may be different from an angle θ4 by which the set of the two rear protrusions 11*b* is inclined relative to the axis of the cylindrical part 11 (θ3<θ4). In other words, the two front protrusions 11*a* and the two rear protrusions 11*b* may not be provided on an identical plane that is parallel to the axis of the cylindrical part 11.

As long as at least the four front protrusions 11*a* and rear protrusions 11*b* inwardly protruding are provided on the inner wall of the cylindrical part 11, even if these four protrusions are not disposed in an arrayed form, the elastic member 30 can urge the male terminal 20 inserted in the cylindrical part 11 of the female terminal 10, toward the four front protrusions 11*a* and rear protrusions 11*b*.

[Action of Connector]

Next, with reference to FIG. 4 to FIG. 6, description will be given of how the connector acts in response to vibration applied thereto in a state where the male terminal 20 is fitted in and connected to the female terminal 10 having the elastic member 30 assembled therein. In this description, the action of the connector of the present invention will be described, in comparison to a conventional connector 100.

Figure 4:
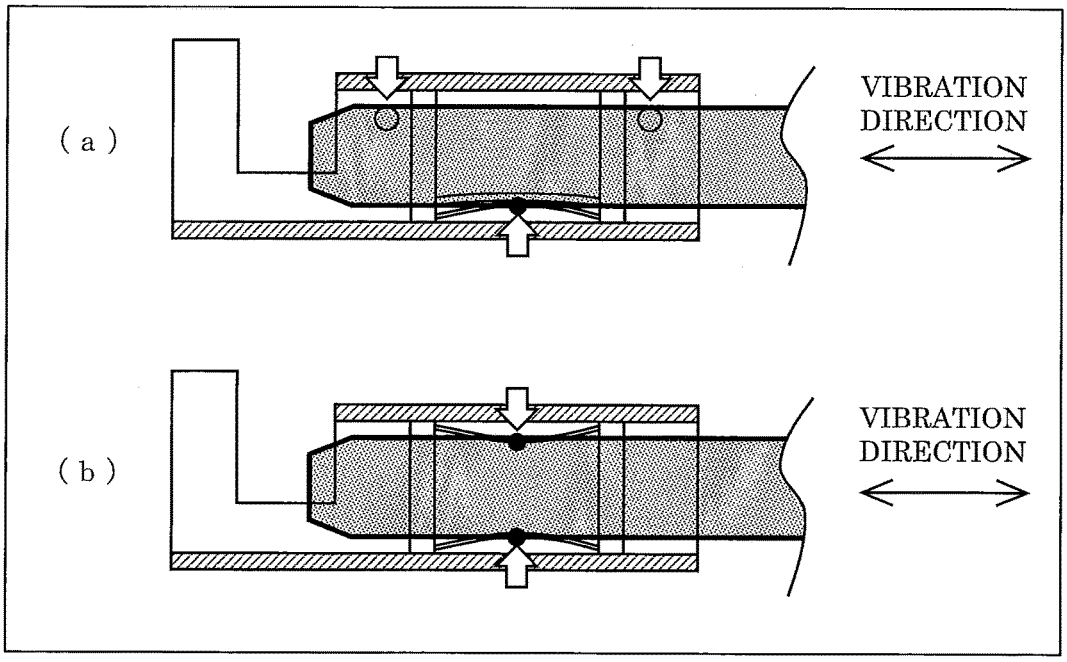
FIG. 4 shows diagrams illustrating actions of connectors that occur in response to vibration in an insertion/extraction direction.

(a) of FIG. 4 is a diagram (a cross-sectional view taken along the line B-B in (b) of FIG. 1) illustrating the action of the connector 1 of the present embodiment that occurs in response to vibration in an insertion/extraction direction. (b) of FIG. 4 is a diagram (a cross-sectional view corresponding to (a) of FIG. 4) illustrating the action of a conventional connector 100 that occurs in response to vibration in the insertion/extraction direction. (a) of FIG. 5 is a diagram (a cross-sectional view in the line D-D in (b) of FIG. 2) illustrating the action of the connector 1 of the present embodiment that occurs in response to vibration in an up-down/left-right direction. (b) of FIG. 5 is a diagram (a cross-sectional view corresponding to (a) of FIG. 5) illustrating the action of the conventional connector 100 that occurs in response to vibration in the up-down/left-right direction. (a) of FIG. 6 is a diagram (a cross-sectional view taken along the line B-B in (b) of FIG. 1) illustrating the action of the connector 1 of the present embodiment that occurs in response to vibration in a prying direction. (b) of FIG. 6 is a diagram (a cross-sectional view corresponding to (a) of FIG. 6) illustrating the action of the conventional connector 100 that occurs in response to vibration in the prying direction.

(1) Action in Response to Vibration in Insertion/Extraction Direction

The vibration in the insertion/extraction direction is vibration that occurs in the direction along which the male terminal 20 is inserted into the female terminal 10, and in the direction along which the male terminal 20 is extracted from the female terminal 10. In the vibration in the insertion/extraction direction, the axis of the male terminal 20 moves in neither the parallel direction nor a non-parallel direction.

As shown in (b) of FIG. 4, the conventional connector 100 has a structure in which the outer circumferential surface of the male terminal 120 is held from all directions under the friction force (white arrows) caused by the contact load (spring load) of the spring part 133 having the plurality of springs which forms the elastic member 130. Due to this structure, in the conventional connector 100, if the force caused by the vibration (solid arrow) in the insertion/extraction direction exceeds the friction force caused by the contact load of the spring part 133 having the plurality of springs, the male terminal 120 moves in the insertion/extraction direction, thereby causing relative movement between the male terminal 120 and the female terminal 110.

In contrast, as shown in (a) of FIG. 4, the connector 1 of the present embodiment has a structure in which a first region (the lower-side region in the drawing) of the outer circumferential surface of the male terminal 20 is held under the friction force (white arrows) caused by the contact load (spring load) of the spring part 33 having three springs which forms the elastic member 30. In addition, the connector 1 of the present embodiment has a structure in which a second region (the upper-side region in the drawing) of the outer circumferential surface of the male terminal 20 is held under the friction force caused by the four front protrusions 11*a* and rear protrusions 11*b* provided in the female terminal 10. In this structure, the holding force caused by the contact load of the spring part 33 of the elastic member 30 is reduced compared to that in the conventional connector 100, but the second region of the outer circumferential surface of the male terminal 20 is held under the friction force caused by the four front protrusions 11*a* and rear protrusions 11*b*. That is, the elastic member 30 urges the male terminal 20 inserted in the cylindrical part 11 of the female terminal 10, toward the front protrusion 11*a* and rear protrusion 11*b* side. Accordingly, the connector 1 of the present embodiment exhibits an effect substantially equal to that of the conventional connector 100, in response to vibration in the insertion/extraction direction.

(2) Action in Response to Vibration in Up-Down/Left-Right Direction

The vibration in the up-down/left-right direction is vibration that occurs in any direction that is orthogonal to the insertion/extraction direction described above. Thus, this vibration not merely means vibration that occurs in the four directions of up, down, left, and right, but means all vibration that occurs in 360° around the insertion/extraction direction (the axis of the cylindrical part 11). In response to the vibration in the up-down/left-right direction, the axis of the male terminal 20 moves in the parallel direction.

Figure 5:
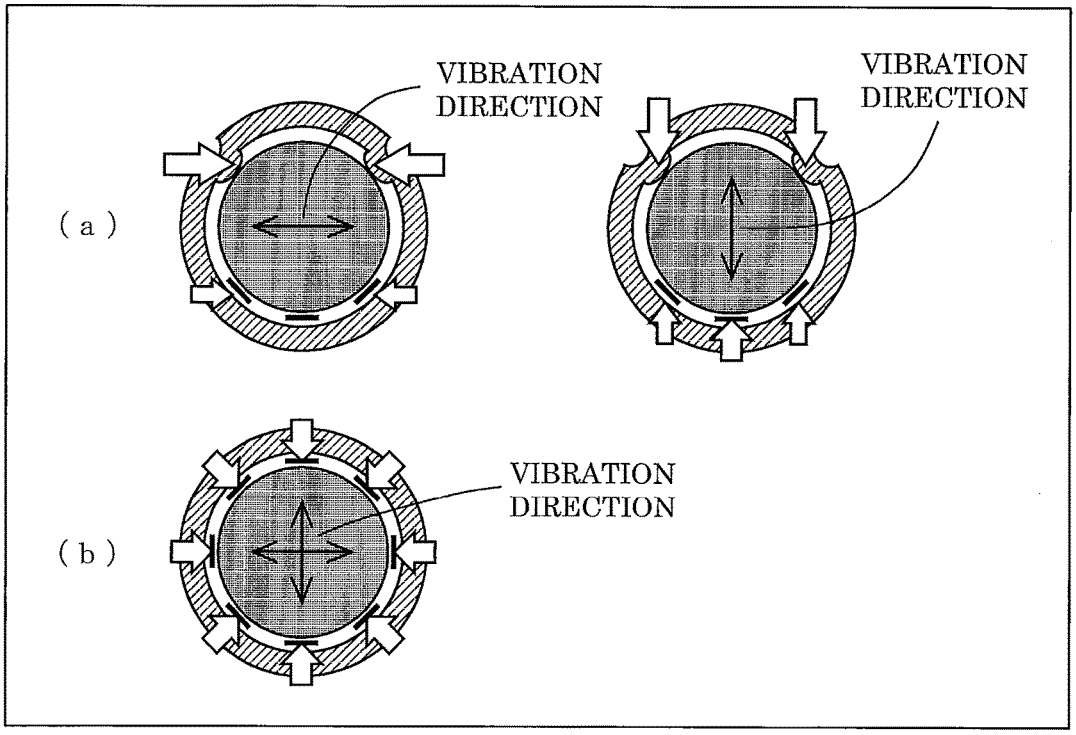
FIG. 5 shows diagrams illustrating actions of connectors that occur in response to vibration in an up-down/left-right direction.

As shown in (b) of FIG. 5, the conventional connector 100 has a structure in which the outer circumferential surface of the male terminal 120 is held from all directions under the pressing force (white arrows) caused by the contact load (spring load) of the spring part 133 having the plurality of springs (eight in the drawings) which forms the elastic member 130. Due to this structure, in the conventional connector 100, if the force caused by the vibration (solid arrows) in the up-down/left-right direction exceeds the pressing force, the male terminal 120 moves in the up-down/left-right direction, thereby causing relative movement between the male terminal 120 and the female terminal 110.

In contrast, as shown in (a) of FIG. 5, the connector 1 of the present embodiment has a structure in which the first region (the lower-side region in the drawing) of the outer circumferential surface of the male terminal 20 is held under the pressing force (white arrows) caused by the contact load (spring load) of the spring part 33 having three springs which forms the elastic member 30. In addition, the connector 1 of the present embodiment has a structure in which the second region (the upper-side region in the drawing) of the outer circumferential surface of the male terminal 20 is held by the two front protrusions 11*a* or the two rear protrusions 11*b* which are provided in the female terminal 10. That is, the elastic member 30 urges the male terminal 20 inserted in the cylindrical part 11 of the female terminal 10, toward the front protrusions 11*a* and the rear protrusions 11*b*. With this structure, as shown in the left drawing in (a) of FIG. 5, in the connector 1 of the present embodiment, even if the force (solid arrows) caused by the vibration in the left-right direction exceeds the pressing force, the male terminal 20 is sandwiched by the two front protrusions 11*a* or the two rear protrusions 11*b*, whereby movement of the male terminal 20 in the left-right direction is restricted. In addition, with this structure, as shown in the right drawing in (a) of FIG. 5, in the connector 1 of the present embodiment, even if the force caused by the vibration (solid arrows) in the up-down direction exceeds the pressing force, upward movement of the male terminal 20 is restricted by the two front protrusions 11*a* or the two rear protrusions 11*b*. Accordingly, the connector 1 of the present embodiment can suppress the male terminal 20 from moving in the up-down/left-right direction in response to the vibration in the up-down/left-right direction and causing relative movement between the male terminal 20 and the female terminal 10.

(3) Action in Response to Vibration in Prying Direction

The vibration in the prying direction is vibration that occurs in the direction along which the conductor barrel part 12 side of the male terminal 20 inserted in the female terminal 10 is moved up and down. In response to the vibration in the prying direction, the axis of the male terminal 20 moves in a non-parallel direction.

Figure 6:
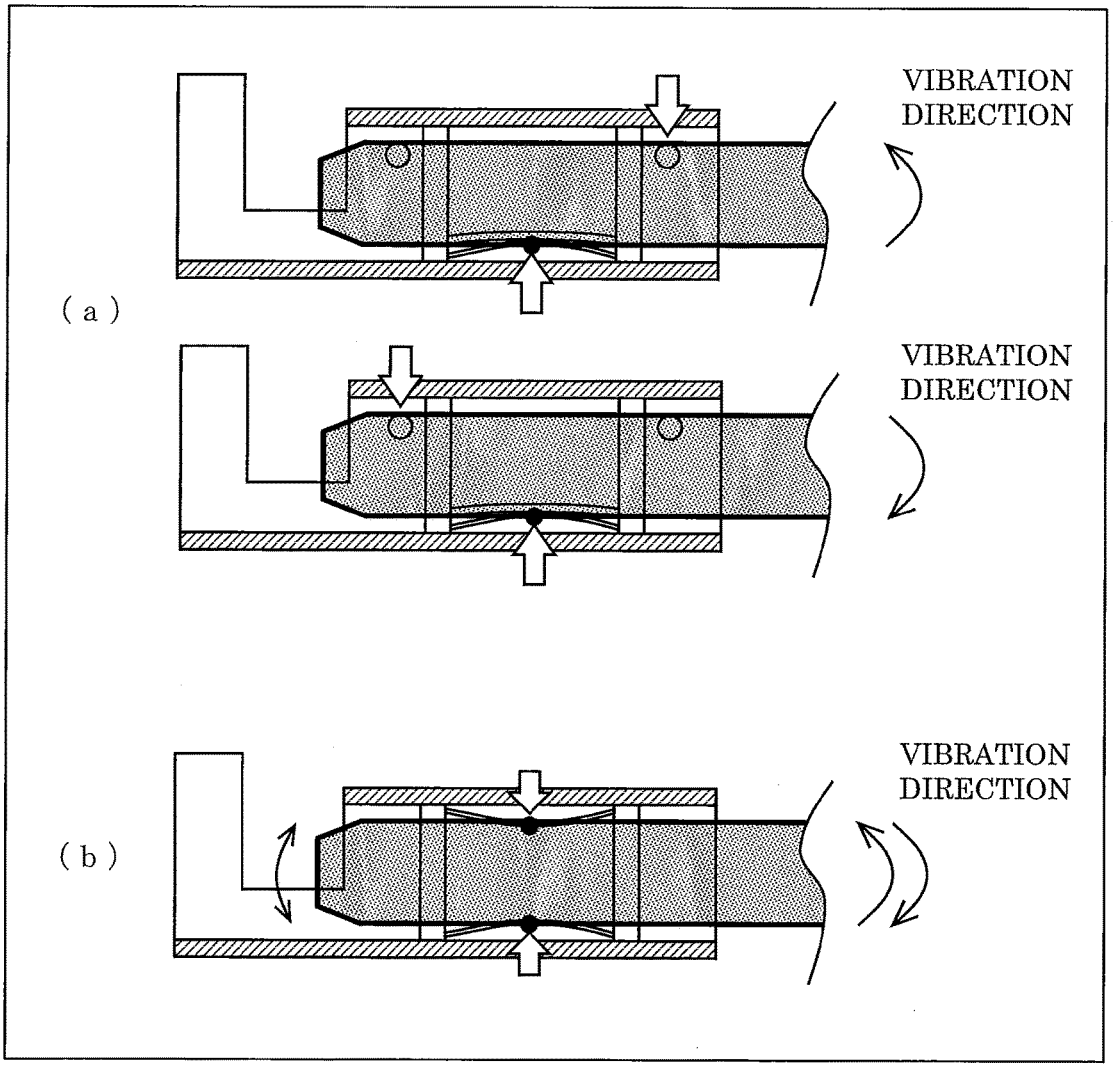
FIG. 6 shows diagrams illustrating actions of connectors that occur in response to vibration in a prying direction.

As shown in (b) of FIG. 6, the conventional connector 100 has a structure in which the outer circumferential surface in the center portion of the male terminal 120 is held from all directions under the pressing force (white arrows) caused by the contact load (spring load) of the spring part 133 having the plurality of springs which forms the elastic member 130. Due to this structure, in the conventional connector 100, there is a gap (clearance) between the male terminal 20 and the female terminal 10 (the elastic member 30) in portions other than the center portion of the male terminal 120. Thus, when vibration (solid arrows) in the prying direction occurs, the male terminal 20 moves in this gap, causing relative movement between the male terminal 20 and the female terminal 10.

In contrast, as shown in (a) of FIG. 6, the connector 1 of the present embodiment has a structure in which the first region (the lower-side region in the drawing) of the outer circumferential surface in the center portion of the male terminal 20 is held under the pressing force caused by the contact load (spring load) of the spring part 33 having three springs which forms the elastic member 30. In addition, the connector 1 of the present embodiment has a structure in which the second region (the upper-side region in the drawing) of the outer circumferential surface, the second region being closer to opposite ends of the cylindrical part 11 relative to the center portion of the male terminal 20, is held by the front protrusions 11*a* and the rear protrusions 11*b* provided in the female terminal 10. That is, the elastic member 30 urges the male terminal 20 inserted in the cylindrical part 11 of the female terminal 10, toward the front protrusions 11*a* and the rear protrusions 11*b*. With this structure, as shown in the upper drawing in (a) of FIG. 6, in the connector 1 of the present embodiment, even if vibration in an upward prying direction (solid arrow) occurs, the male terminal 20 is held by the front protrusions 11*a* and the elastic member 30, whereby movement of the male terminal 20 in the upward prying direction is restricted. In addition, with this structure, as shown in the lower drawing in (a) of FIG. 6, in the connector 1 of the present embodiment, even if vibration (solid arrow) in a downward prying direction occurs, the male terminal 20 is held by the rear protrusions 11*b* and the elastic member 30, whereby movement of the male terminal 20 in the upward prying direction is restricted. Accordingly, the connector 1 of the present embodiment can suppress the male terminal 20 from moving in the prying direction in response to the vibration in the prying direction and causing relative movement between the male terminal 20 and the female terminal 10.

Effect of Embodiment

As described above, according to the connector 1 of the present invention, the front protrusions 11*a* and the rear protrusions 11*b* which are inwardly protruding are formed on the inner wall of the cylindrical part 11 of the female terminal 10 having the male terminal 20 fitted therein. In addition, the spring part 33 capable of applying elastic force and forming the elastic member 30 is disposed on the opposite side to the front protrusions 11*a* and the rear protrusions 11*b*, relative to the axis of the cylindrical part 11. Then, the male terminal 20 fitted in the cylindrical part 11 of the female terminal 10 is sandwiched by the front protrusions 11*a* and the rear protrusions 11*b* as well as the spring part 33 of the elastic member 30. That is, the elastic member 30 urges the male terminal 20 inserted in the cylindrical part 11 of the female terminal 10, toward the front protrusions 11*a* and the rear protrusions 11*b*. Accordingly, even if the magnitude of vibration applied to the connector 1 exceeds the pressing force holding the male terminal 20, movement of the male terminal 20 is restricted by the front protrusions 11*a* and the rear protrusions 11*b*. Thus, relative movement of the male terminal 20 relative to the female terminal 10 can be suppressed. Moreover, it is possible to reduce the risk that contact sliding occurs between the male terminal 20 and the female terminal 10 (the elastic member 30) and the resistance value is increased due to abrasive wear of the contacts.

Figure 7:
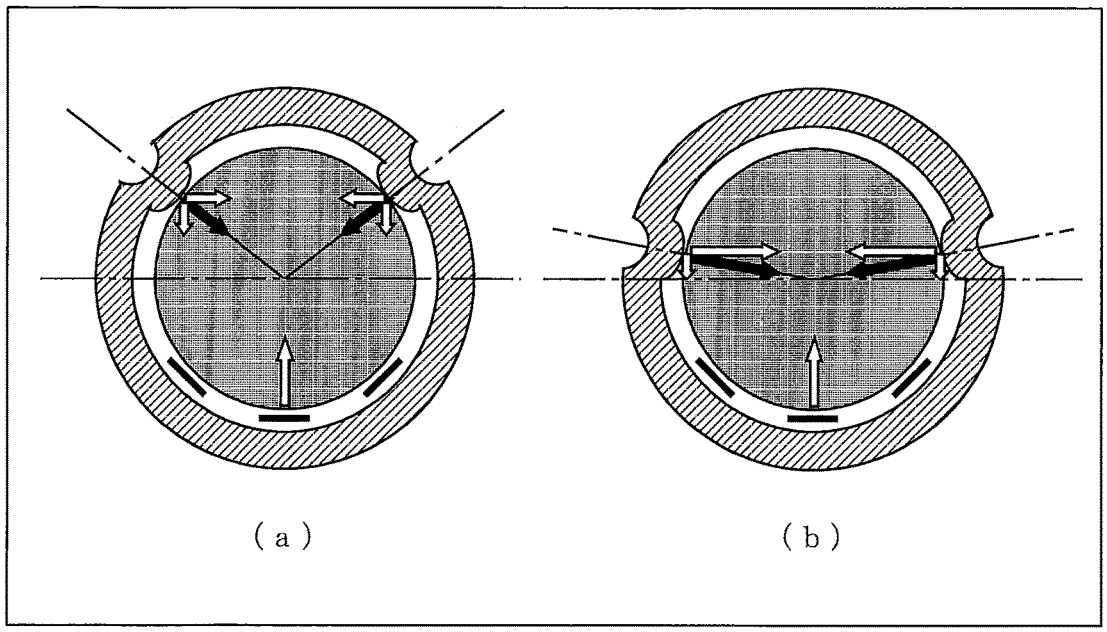
FIG. 7 shows diagrams illustrating the relationship between the positions of protrusions of a female terminal and contact load.

It should be noted that the connector 1 according to the present embodiment described above has a structure of a connector using a so-called round-pin-type terminal, in which the male terminal 20 having a substantially cylindrical shape is inserted into the female terminal 10 having a substantially cylindrical shape. In this structure, even in the case where the same contact load is applied by the elastic member 30 to the male terminal 20, if the positions of the front protrusions 11*a* and the rear protrusions 11*b* formed on the inner wall of the cylindrical part 11 are changed, the contact load applied by the front protrusions 11*a* and the rear protrusions 11*b* to the male terminal 20 can be changed (for example, see FIG. 7). Thus, without changing the design of the elastic member 30, a required contact load can be set.

[Modification 1]

Figure 8:
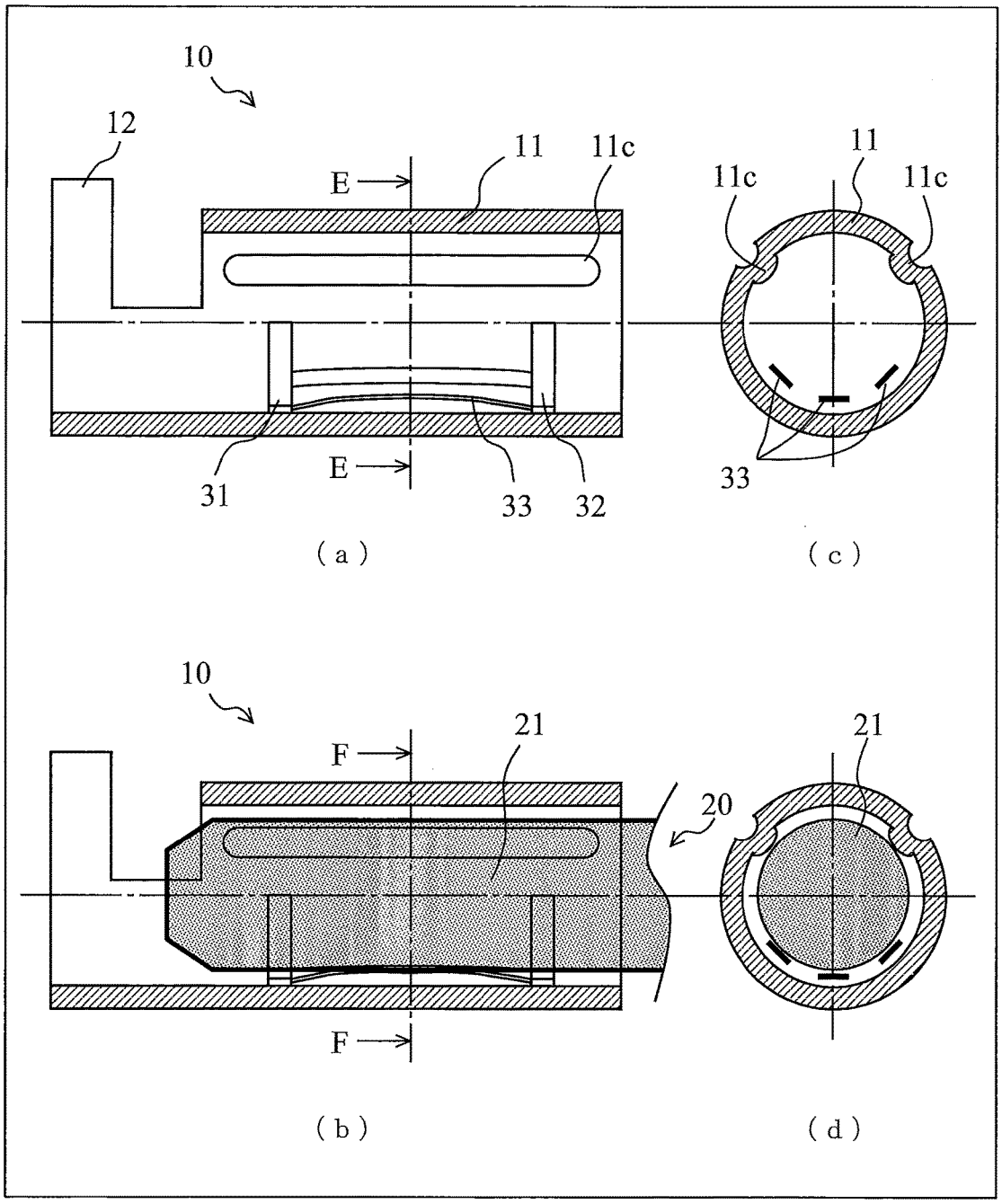
FIG. 8 shows cross-sectional views showing the structure of the connector in Modification 1 according to one embodiment of the present invention.

(a) of FIG. 8 is a side cross-sectional view of the female terminal 10 alone in the connector according to Modification 1. (b) of FIG. 8 is a side cross-sectional view when the female terminal 10 and the male terminal 20 are fitted together in the connector according to Modification 1. (c) of FIG. 8 is a cross-sectional view taken along a line E-E in (a) of FIG. 8. (d) of FIG. 8 is a cross-sectional view taken along a line F-F in (b) of FIG. 8.

In the connector according to Modification 1, two bead parts 11*c* inwardly protruding and extending in the axial direction of the cylindrical part 11 are used, instead of the two front protrusions 11*a* and the two rear protrusions 11*b* formed on the inner wall of the cylindrical part 11. The two bead parts 11*c* are provided, in parallel to the axis of the cylindrical part 11, at positions where two straight lines extending from one point on the axis of the cylindrical part 11 cross the inner wall of the tubular part of the cylindrical part 11, the two straight lines forming a predetermined angle and each being perpendicular to the axis of the cylindrical part 11. Further, in the connector according to Modification 1, each of the frame parts 31 and 32 of the elastic member 30 is formed in a semicircular shape, not in an annular shape. It is sufficient that the frame parts 31 and 32 are formed in a range where the frame parts 31 and 32 do not interfere with the bead parts 11*c*, and the shape of each of the frame parts 31 and 32 is not limited to the semicircular shape shown. The elastic member 30 having such a shape is assembled inside the cylindrical part 11, by means of a holding mechanism not shown.

In the structure in Modification 1 above, the male terminal 20 fitted in the female terminal 10 can be pressed and held by the two bead parts 11*c* and the spring part 33 of the elastic member 30. Thus, the connector according to Modification 1 can also similarly exhibit the effect of the embodiment described above.

[Modification 2]

Figure 9:
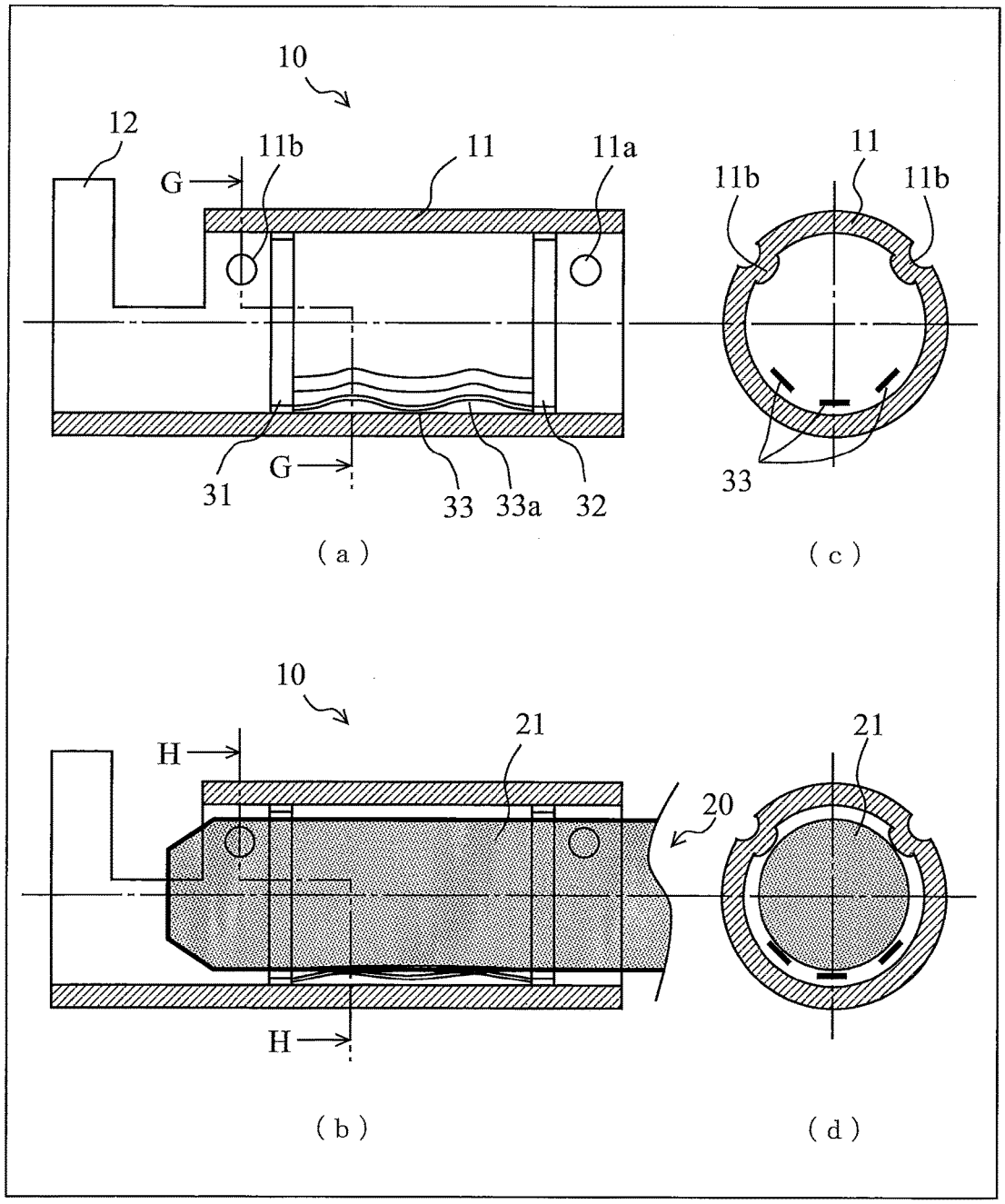
FIG. 9 shows cross-sectional views showing the structure of the connector in Modification 2 according to one embodiment of the present invention.

(a) of FIG. 9 is a side cross-sectional view of the female terminal 10 alone in the connector according to Modification 2. (b) of FIG. 9 is a side cross-sectional view when the female terminal 10 and the male terminal 20 are fitted together in the connector according to Modification 2. (c) of FIG. 9 is a cross-sectional view taken along a line G-G in (a) of FIG. 9. (d) of FIG. 9 is a cross-sectional view taken along a line H-H in (b) of FIG. 9.

In the connector according to Modification 2, the spring part 33 of the elastic member 30 has a shape in which projecting portions 33*a* each curving toward the axis side of the frame parts 31 and 32 are respectively formed at two positions. It should be noted that the projecting portions 33*a* may be formed at three or more positions.

In the structure in Modification 2 above, the male terminal 20 fitted in the female terminal 10 can be pressed and held by the plurality of projecting portions 33*a* of the elastic member 30. Thus, the connector according to Modification 2 can also similarly exhibit the effect of the embodiment described above.

[Modification 3]

Figure 10:
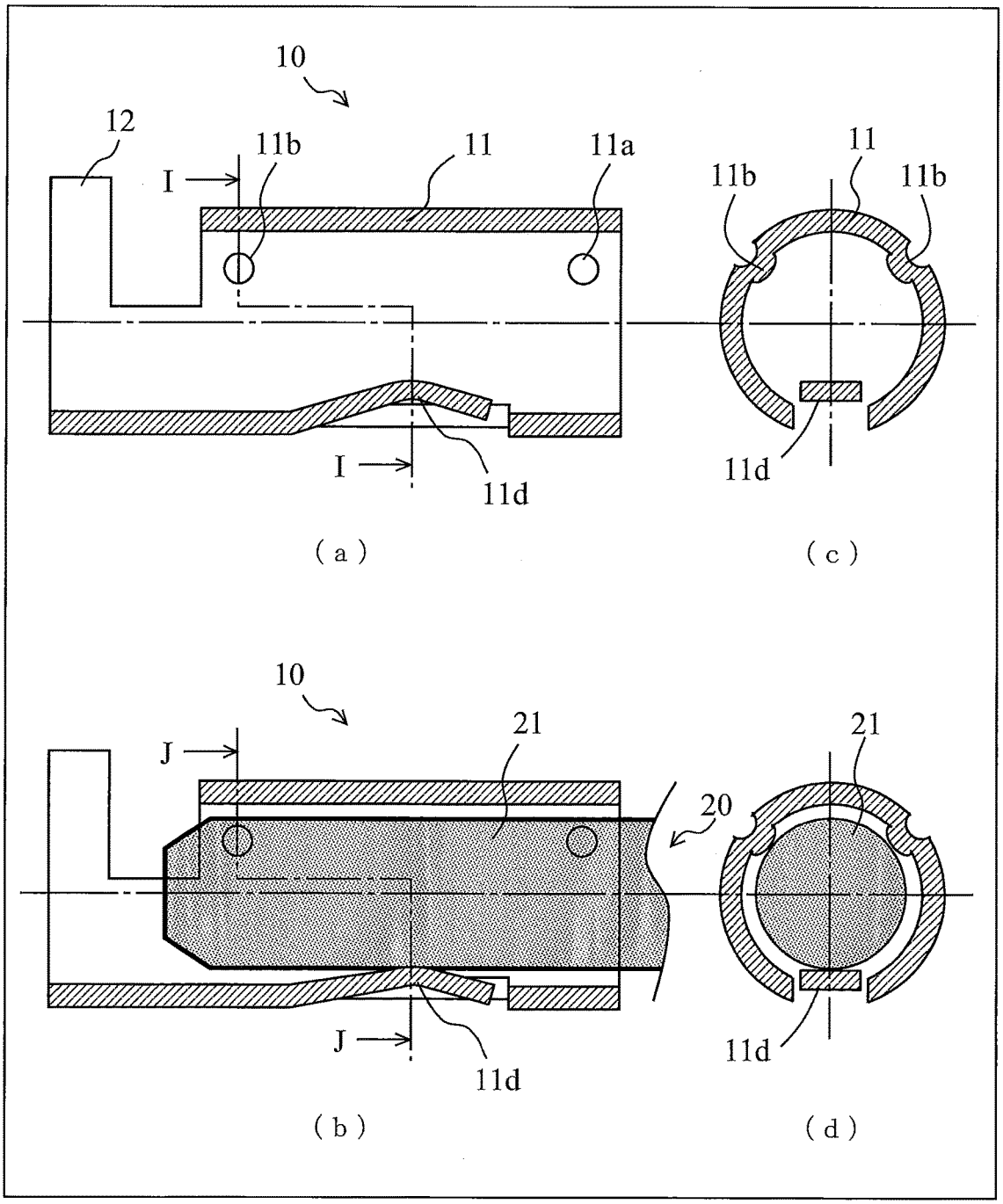
FIG. 10 shows cross-sectional views showing the structure of the connector in Modification 3 according to one embodiment of the present invention.

(a) of FIG. 10 is a side cross-sectional view of the female terminal 10 alone in the connector according to Modification 3. (b) of FIG. 10 is a side cross-sectional view when the female terminal 10 and the male terminal 20 are fitted together in the connector according to Modification 3. (c) of FIG. 10 is a cross-sectional view taken along a line I-I in (a) of FIG. 10. (d) of FIG. 10 is a cross-sectional view taken along a line J-J in (b) of FIG. 10.

In the connector according to Modification 3, instead of the spring part 33 of the elastic member 30, a cut-and-raised spring part 11*d* is used which is formed by cutting and raising a portion of the cylindrical part 11 so as to be capable of applying elastic force toward the axis side of the cylindrical part 11.

In the structure in Modification 3 above, the male terminal 20 fitted in the female terminal 10 can he pressed and held by the cut-and-raised spring part 11*d*. Thus, the connector according to Modification 3 can also similarly exhibit the effect of the embodiment described above.

[Other Modifications]

Figure 11:
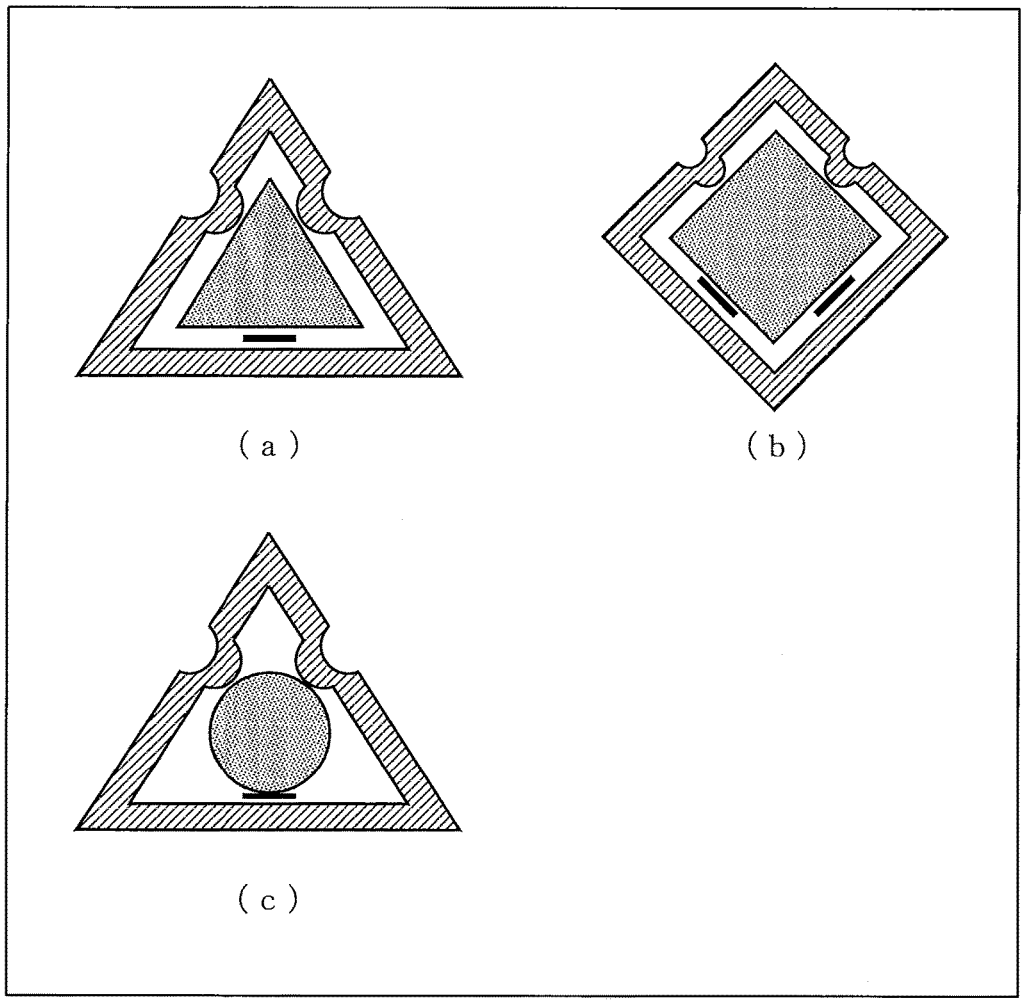
FIG. 11 shows cross-sectional views showing examples of the structure of the connector in other modifications according to one embodiment of the present invention.
Figure 12:
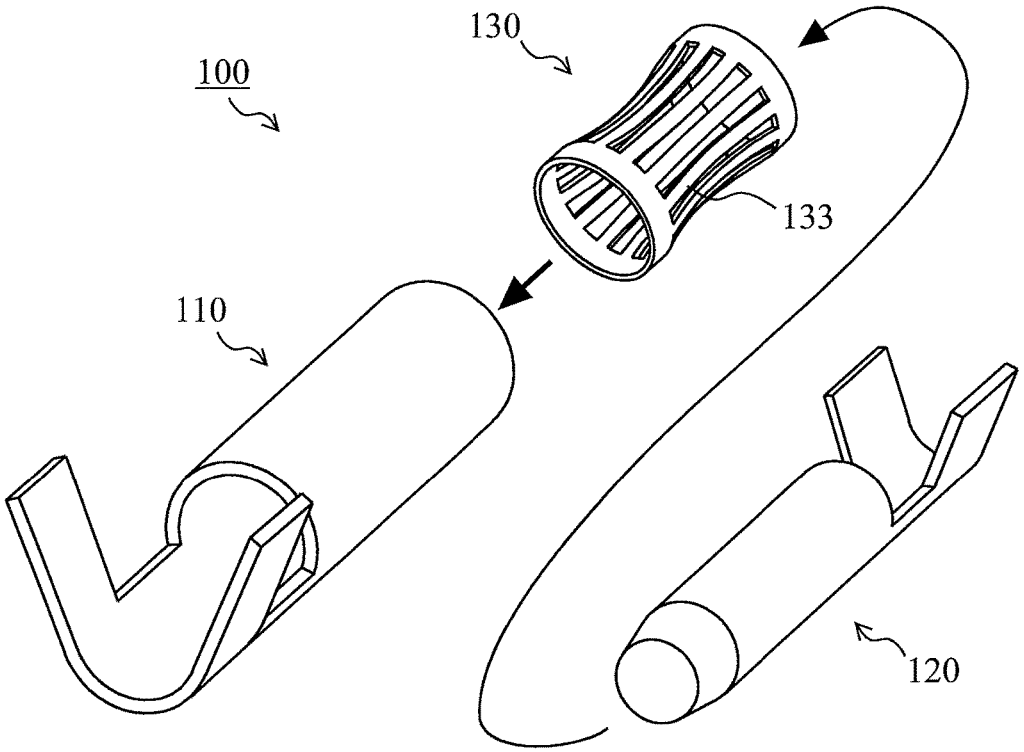
FIG. 12 is a perspective view showing an example of the structure of a conventional connector.

In the above embodiment, a connector structure using a combination of a round-pin-type male terminal and a cylinder-type female terminal has been described. However, other than this structure, a connector structure using triangular-pin-type terminals ((a) of FIG. 11), or a connector structure using quadrangular-pin-type terminals ((a) of FIG. 11) may be employed. Further, a connector structure using a combination of a triangular-pin-type female terminal and a round-pin-type male terminal ((c) of FIG. 11) may be employed.

The connector of the present invention is useful when relative movement of the male terminal relative to the female terminal is to be suppressed even if the magnitude of vibration applied to the connector exceeds the pressing force holding the male terminal and the female terminal.

While the present invention has been described in detail, the foregoing description is merely an example of the present invention in all aspect illustrative and not restrictive. It is understood that numerous other modifications can be made without departing from the scope of the present invention.

What is claimed is:

1. A connector comprising:

a male terminal;

a female terminal having a tubular part into which the male terminal is inserted; and an elastic member that has a spring part capable of applying elastic force and that is assembled inside the tubular part of the female terminal, wherein a plurality of protrusions inwardly protruding are formed on an inner wall of the tubular part of the female terminal, the plurality of protrusions at least include: two first protrusions provided at positions where two first straight lines extending from one point on an axis of the tubular part cross the inner wall of the tubular part, the two first straight lines forming a first angle therebetween and each being perpendicular to the axis of the tubular part; and two second protrusions provided at positions where two second straight lines extending from one point on the axis of the tubular part cross the inner wall of the tubular part, the two second straight lines forming a second angle and each being perpendicular to the axis of the tubular part, the two first protrusions and the two second protrusions being provided in a direction parallel to the axis of the tubular part which is an insertion/extraction direction of the male terminal, the elastic member is assembled inside the tubular part such that the spring part is located on the opposite side to the two first protrusions and the two second protrusions relative to the axis of the tubular part, and the elastic member urges the male terminal inserted in the tubular part of the female terminal, toward the two first protrusions side and the two second protrusions side.

2. The connector according to claim 1, wherein the first angle formed between the two first straight lines is identical to the second angle formed between the two second straight lines.

3. The connector according to claim 2, wherein the two first protrusions and the two second protrusions are provided on an identical plane that is parallel to the axis of the tubular part.

* * * * *